US008041498B2

(12) United States Patent
Brown et al.

(10) Patent No.: US 8,041,498 B2
(45) Date of Patent: Oct. 18, 2011

(54) LEAN NITROGEN OXIDE EMISSION CONTROL SYSTEM AND METHOD

(75) Inventors: David B. Brown, Brighton, MI (US); David J. Cleary, Shanghai (CN); Wei Li, Troy, MI (US)

(73) Assignee: GM Global Technology Operations LLC

( * ) Notice: Subject to any disclaimer, the term of this patent is extended or adjusted under 35 U.S.C. 154(b) by 210 days.

(21) Appl. No.: 12/248,246

(22) Filed: Oct. 9, 2008

(65) Prior Publication Data

US 2010/0057328 A1 Mar. 4, 2010

Related U.S. Application Data

(60) Provisional application No. 61/092,816, filed on Aug. 29, 2008.

(51) Int. Cl.
*F02D 41/00* (2006.01)
*F01N 3/00* (2006.01)

(52) U.S. Cl. ..... 701/103

(58) Field of Classification Search ..... 701/101, 701/103, 104; 60/286, 295, 276, 277, 285
See application file for complete search history.

(56) References Cited

U.S. PATENT DOCUMENTS

| | | | | |
|---|---|---|---|---|
| 5,021,227 | A * | 6/1991 | Kobayashi et al. | 423/212 |
| 5,778,667 | A * | 7/1998 | Kinugasa et al. | 60/274 |
| 6,662,552 | B1 * | 12/2003 | Gunther et al. | 60/286 |
| 6,775,623 | B2 | 8/2004 | Ali | |
| 7,472,545 | B2 * | 1/2009 | Hemingway et al. | 60/286 |
| 7,673,444 | B2 * | 3/2010 | Yano et al. | 60/277 |
| 2002/0069640 | A1 * | 6/2002 | Irisawa et al. | 60/285 |
| 2007/0137182 | A1 * | 6/2007 | Driscoll | 60/286 |

* cited by examiner

*Primary Examiner* — Hieu T Vo

(57) ABSTRACT

A control system comprising an $NH_3$ storage level determination module that determines an $NH_3$ storage level in an exhaust system, and a fuel control module that controls an air-to-fuel (A/F) ratio in an engine based on the $NH_3$ storage level. A method comprising determining an $NH_3$ storage level in an exhaust system, and controlling an A/F ratio in an engine based on the $NH_3$ storage level.

20 Claims, 4 Drawing Sheets

LEAN NITROGEN OXIDE EMISSION CONTROL SYSTEM AND METHOD

CROSS-REFERENCE TO RELATED APPLICATIONS

This application claims the benefit of U.S. Provisional Application No. 61/092,816, filed on Aug. 29, 2008. The disclosure of the above application is incorporated herein by reference.

FIELD

The present disclosure relates to emissions control systems and methods for internal combustion engines, and more particularly to lean nitrogen oxide ($NO_x$) emissions control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines may be operated at a lean air-to-fuel (A/F) ratio to improve fuel economy. Nitrogen oxide ($NO_x$) emissions produced during lean operation are controlled. Selective catalytic reduction (SCR) catalysts, dosing systems, and lean $NO_x$ trap (LNT) catalysts are commonly used with internal combustion engines for emissions reduction.

In a typical SCR process, $NO_x$ reacts with a reductant which is injected by the dosing system into the exhaust gas stream to be absorbed onto an SCR catalyst. The injected dosing agent (e.g., urea) breaks down to form ammonia ($NH_3$). $NH_3$ reacts with $NO_x$ to reduce $NO_x$ into nitrogen ($N_2$) and water ($H_2O$).

LNT catalysts may absorb $NO_x$ from exhaust gas when the SCR unit cannot effectively reduce $NO_x$ emission during an engine start-up period. LNT catalysts may release the absorbed $NO_x$ after the exhaust gas reaches a predetermined temperature where the SCR unit can effectively convert $NO_x$ into $N_2$ and $H_2O$. As a result, $NO_x$ emission released to the atmosphere during the engine start-up period may be reduced.

SUMMARY

The present disclosure provides a control system comprising an $NH_3$ storage level determination module that determines an $NH_3$ storage level in an exhaust system, and a fuel control module that controls an air-to-fuel (A/F) ratio in an engine based on the $NH_3$ storage level. In addition, the present disclosure provides a method comprising determining an $NH_3$ storage level in an exhaust system, and controlling an A/F ratio in an engine based on the $NH_3$ storage level.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
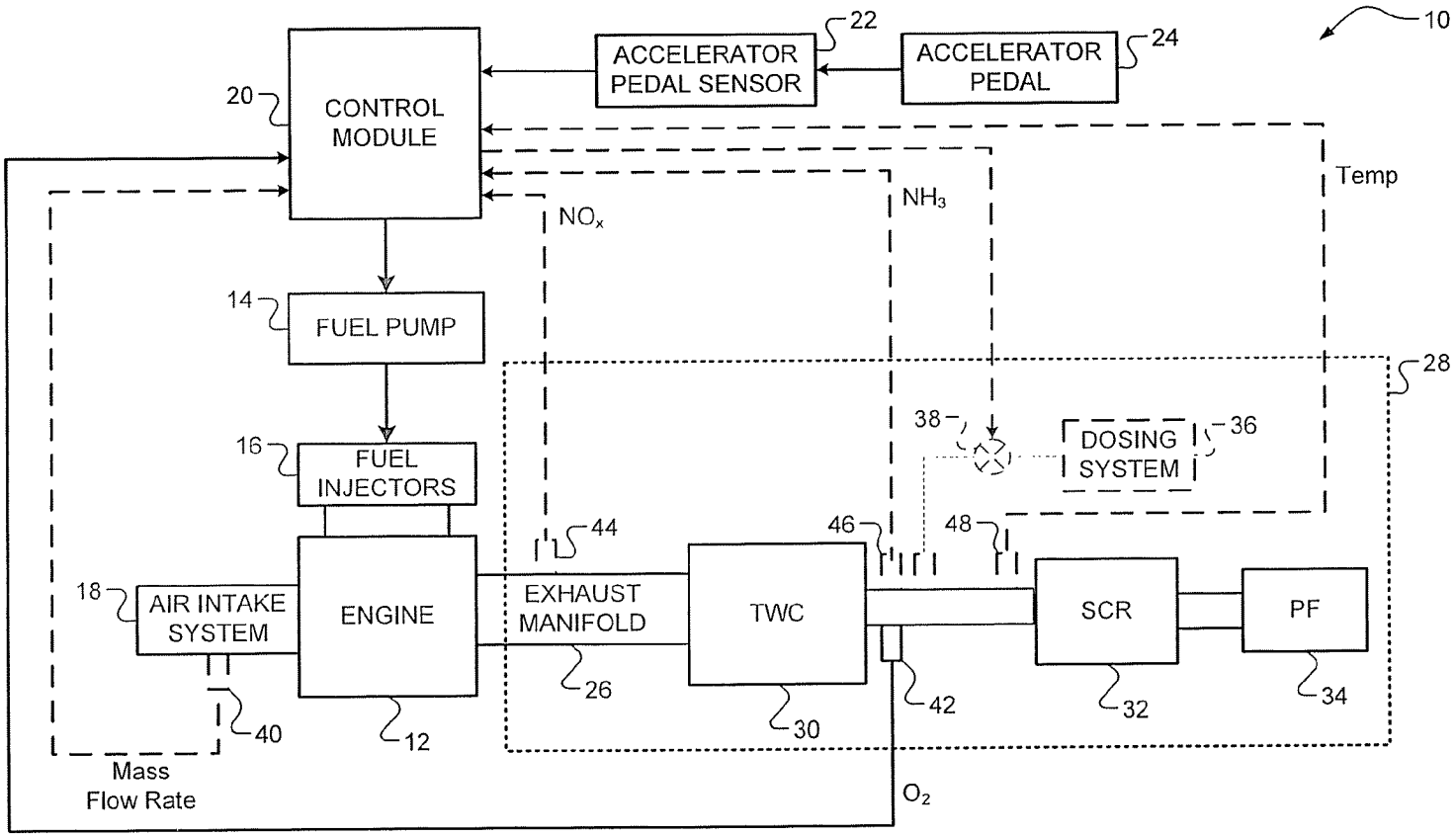
FIG. 1 is a schematic illustration of a vehicle including an emission control system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

An emissions control system according to the present disclosure may include a fuel control module and a three way catalyst (TWC) disposed upstream from a selective catalyst reduction (SCR) unit. The fuel control module modulates an air-to-fuel (A/F) ratio in an engine based on a $NH_3$ storage level. Nitrogen oxide ($NO_x$) reacts with other exhaust emissions at the TWC to yield ammonia ($NH_3$) during rich operation. The SCR unit stores $NH_3$ from exhaust gas. Stored $NH_3$ reacts with $NO_x$ in the exhaust gas to yield nitrogen ($N_2$) and water ($H_2O$) during lean operation. As a result, $NO_x$ emissions released to the atmosphere during lean operation may be reduced.

Referring now to FIG. 1, a vehicle 10 including an emission control system in accordance with the principles of the present disclosure is shown. Fuel is delivered to an engine 12 from a fuel pump 14 through a plurality of fuel injectors 16. Air is delivered to the engine 12 through an air intake system 18.

A control module 20 communicates with an accelerator pedal sensor 22. The accelerator pedal sensor 22 sends a signal representative of a pedal position of an accelerator pedal 24 to the control module 20. The control module 20 uses the pedal position signal in controlling operation of the fuel pump 14 and the fuel injectors 16.

Exhaust is produced through the combustion process and is exhausted from the engine 12 into an exhaust manifold 26. An exhaust system 28 receives the exhaust from the engine 12 through the exhaust manifold 26 and treats the exhaust flowing therethrough to reduce emissions, such as $NO_x$, HC, and CO, before the exhaust is released to the atmosphere.

The exhaust system 28 includes a three way catalyst (TWC) 30 and a SCR unit 32. The exhaust system 28 may include a particulate filter (PF) 34, a dosing system 36, and a valve 38. The PF 34 removes particulate matter or soot from the exhaust downstream of the SCR unit 32. The dosing system 36 contains a reductant additive, such as urea. The control module 20 controls the valve 38 to release precise amounts of the reductant additive from the dosing system 36 into the exhaust stream. The gaseous or liquid reductant is added to the exhaust and is absorbed onto the SCR unit 32.

The TWC 30 and the SCR unit 32 remove $NO_x$ and other emissions in the exhaust through chemical reactions. At the TWC 30, nitrogen oxide ($NO_x$) reacts with carbon monoxide (CO), hydrogen ($H_2$), hydrocarbons (HC), and water ($H_2O$) in the exhaust to yield ammonia ($NH_3$) when an air-to-fuel (A/F) ratio in the engine 12 is rich. The SCR unit 32 stores $NH_3$ produced in the TWC 30. The stored $NH_3$ and an SCR catalyst in the SCR unit 32 react with $NO_x$ in the exhaust to yield nitrogen ($N_2$) and $H_2O$ when the A/F ratio in the engine 12 is lean.

The SCR unit 32 may remove $NO_x$ in the exhaust through a chemical reaction between the exhaust gases, the reductant additive (e.g. urea), and the SCR catalyst. Heat in the exhaust stream causes the aqueous urea solution to decompose into $NH_3$ and hydro-cyanic acid (HNCO). These decomposition products enter the SCR unit 32, where the HNCO further decomposes into gas phase $NH_3$ and the gas phase $NH_3$ is absorbed. The absorbed $NH_3$ reacts with $NO_x$ in the exhaust to form $H_2O$ and $N_2$.

The SCR unit 32 may store $NH_3$ produced in the TWC 30 most effectively (i.e., nearly 100%) when the SCR unit 32 is within an optimal temperature range. The optimal temperature range may depend on a number of factors, including a SCR catalyst type or coating. For example only, the optimal temperature range may be approximately between 250° C. and 350° C.

The air intake system 18 may include an airflow meter 40 that detects an air mass flow rate. The exhaust system 28 includes an oxygen ($O_2$) sensor 42 that detects an $O_2$ concentration in the exhaust downstream of the TWC 30. The exhaust system 28 may include a $NO_x$ sensor 44, a $NH_3$ sensor 46, and a temperature sensor 48. The $NO_x$ sensor 44 detects a $NO_x$ concentration in the exhaust at the exhaust manifold 26. The $NH_3$ sensor 46 detects a $NH_3$ concentration in the exhaust downstream of the TWC 30. The temperature sensor 48 may detect an exhaust temperature between the SCR unit 32 and the TWC 30, as depicted in FIG. 1. Alternatively, the temperature sensor 48 may detect an exhaust temperature in the SCR unit 32 or the TWC 30.

The control module 20 controls the A/F ratio in the engine 12 via the fuel pump 14 and the fuel injectors 16 based on the $NH_3$ storage level. The control module 20 receives the $O_2$ concentration from the $O_2$ sensor 42. The control module 20 may receive the air mass flow rate from the airflow meter 40, the $NO_x$ concentration from the $NO_x$ sensor 44, the $NH_3$ concentration from the $NH_3$ sensor 46, and the exhaust temperature from the temperature sensor 48.

Figure 2:
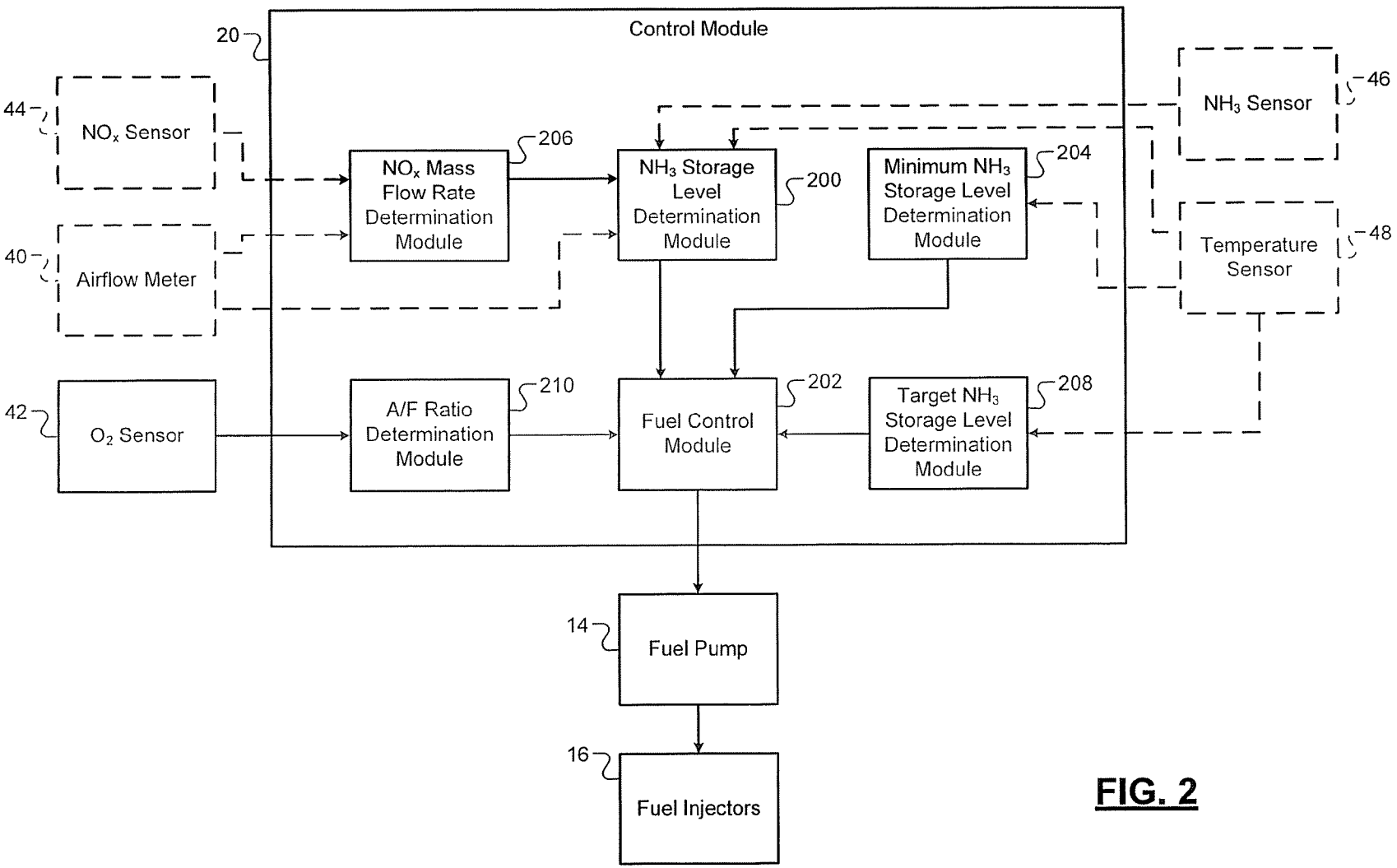
FIG. 2 is a functional block diagram of a control module including an ammonia ($NH_3$) storage level determination module and a fuel control module according to the principles of the present disclosure.

Referring now to FIG. 2, the control module 20 includes an $NH_3$ storage level determination module 200, a fuel control module 202, a minimum $NH_3$ storage level determination module 204, a $NO_x$ mass flow rate determination module 206, a target $NH_3$ storage level determination module 208, and an air-to-fuel (A/F) ratio determination module 210. The $NH_3$ storage level determination module 200 determines a $NH_3$ storage level in the exhaust system 28 based on a previous $NH_3$ storage level and a change in the $NH_3$ storage level. The fuel control module 202 controls an A/F ratio in the engine 12 via the fuel pump 14 and the fuel injectors 16 based on the $NH_3$ storage level determined by the $NH_3$ storage level determination module 200.

The minimum $NH_3$ storage level determination module 204 may determine a minimum $NH_3$ storage level based on the exhaust temperature from the temperature sensor 48. Alternatively, the minimum $NH_3$ storage level determination module 204 may estimate the exhaust temperature based on engine operating conditions (e.g., temperature, pressure, $O_2$ content) and determine the minimum $NH_3$ storage level based on the estimated exhaust temperature. The minimum $NH_3$ storage level determination module 204 provides the minimum $NH_3$ storage level to the fuel control module 202.

The $NO_x$ mass flow rate determination module 206 may determine a $NO_x$ mass flow rate based on the $NO_x$ concentration from the $NO_x$ sensor 44, the air mass flow rate from the airflow meter 40, and a fuel mass flow rate. The fuel mass flow rate may be determined based on a control signal from the fuel control module 202 to the fuel injectors 16 and/or based on an A/F sensor located upstream from the TWC 30.

Alternatively, the $NO_x$ mass flow rate determination module 206 may estimate the $NO_x$ concentration, the air mass flow rate, and the fuel mass flow rate, then determine the $NO_x$ mass flow rate based on the estimated $NO_x$ concentration, the estimated air mass flow rate, and the estimated fuel mass flow rate. The $NO_x$ concentration, the air mass flow rate, and the fuel mass flow rate may be estimated based on the engine operating conditions. Estimating the $NO_x$ concentration based on the engine operating conditions is disclosed in U.S. Pat. No. 6,775,623, which is incorporated herein by reference. The $NO_x$ mass flow rate determination module 206 provides the $NO_x$ mass flow rate to the $NH_3$ storage level determination module 200.

The target $NH_3$ storage level determination module 208 may determine a target $NH_3$ storage level based on the air mass flow rate from the airflow meter 40, the fuel mass flow rate from the fuel control module 202, and the exhaust temperature from the temperature sensor 48. Alternatively, the target $NH_3$ storage level determination module 208 may estimate the air mass flow rate, the fuel mass flow rate and the exhaust temperature based on the engine operating conditions and determine the target $NH_3$ storage level based thereon. The target $NH_3$ storage level may be calculated such that its magnitude is above the minimum $NH_3$ storage level and below the $NH_3$ saturation point of the SCR unit 32. For example only, the target $NH_3$ storage level may be set within a range from 20% to 30% below the $NH_3$ saturation point of the SCR unit 32. The target $NH_3$ storage level determination module 204 provides the target $NH_3$ storage level to the fuel control module 202.

The A/F ratio determination module 210 determines a post TWC A/F ratio (i.e., A/F ratio of the exhaust downstream of the TWC 30) based on the $O_2$ concentration from the $O_2$ sensor 42. High levels of $O_2$ concentration indicate a lean A/F ratio, while low levels of $O_2$ concentration indicate a rich A/F ratio. The A/F ratio determination module 210 provides the post TWC A/F ratio to the fuel control module 202.

The fuel control module 202 determines whether the $NH_3$ storage level is greater than the minimum $NH_3$ storage level. When the $NH_3$ storage level is greater than the minimum $NH_3$ storage level, the fuel control module 202 sets the A/F ratio in the engine 12 to lean and the $NH_3$ storage level determination module 200 determines a decrease in the $NH_3$ storage level based on the $NO_x$ mass flow rate from the $NO_x$ mass flow rate determination module 206. More specifically, the $NH_3$ storage level determination module 200 may calculate the decrease in the $NH_3$ storage level based on an assumed relationship of 0.5 gram of $NH_3$ consumed for each gram of $NO_x$ detected, which may be modified based on the exhaust temperature from the temperature sensor 48 and a SCR catalyst type.

When the $NH_3$ storage level is less than the minimum $NH_3$ storage level, the fuel control module 202 sets the A/F ratio in the engine 12 to rich and the A/F ratio determination module 210 determines whether the post TWC A/F ratio is rich. When the post TWC A/F ratio is not rich, the fuel control module 202 continues to monitor the $NH_3$ storage level to determine whether the A/F ratio may be set to lean. When the post TWC A/F ratio is rich, the $NH_3$ storage level determination module 200 determines an increase in the $NH_3$ storage level based on the $NO_x$ mass flow rate from the $NO_x$ mass flow rate determination module 206 and the fuel control module 202 determines whether the $NH_3$ storage level exceeds the target storage level. The $NH_3$ storage level determination module 200 may also determine the increase in the $NH_3$ storage level based on the A/F ratio and the exhaust temperature from the temperature sensor 48.

The $NH_3$ storage level determination module 200 may determine the increase in the $NH_3$ storage level based on the $NO_x$ mass flow rate from the $NO_x$ mass flow rate determination module 206. More specifically, the $NH_3$ storage level determination module 200 may calculate the increase in the $NH_3$ storage level based on a relationship of 0.5 grams of $NH_3$ produced for each gram of $NO_x$ detected, which may be modified based on the exhaust temperature from the temperature sensor 48. Alternatively, the $NH_3$ storage level determination module 200 may determine the increase in the $NH_3$ storage level based on the $NH_3$ concentration from the $NH_3$ sensor 46, the air mass flow rate from the airflow meter 40, and the fuel mass flow rate from the fuel control module 202.

When the $NH_3$ storage level does not exceed the target storage level, the $NH_3$ storage level determination module 200 continues to determine the increase in the $NH_3$ storage level based on the $NO_x$ mass flow rate. When the $NH_3$ storage level exceeds the target storage level, the fuel control module 202 again determines whether the A/F ratio may be set to lean. When the A/F ratio may be set to lean, the fuel control module 202 sets the A/F ratio in the engine 12 to lean and monitors the $NH_3$ storage level. When the A/F ratio may not be set to lean, the fuel control module 202 sets the A/F ratio in the engine 12 to stoichiometric and continues to monitor the lean burn conditions to determine whether the A/F ratio may be set to lean.

Figure 3:
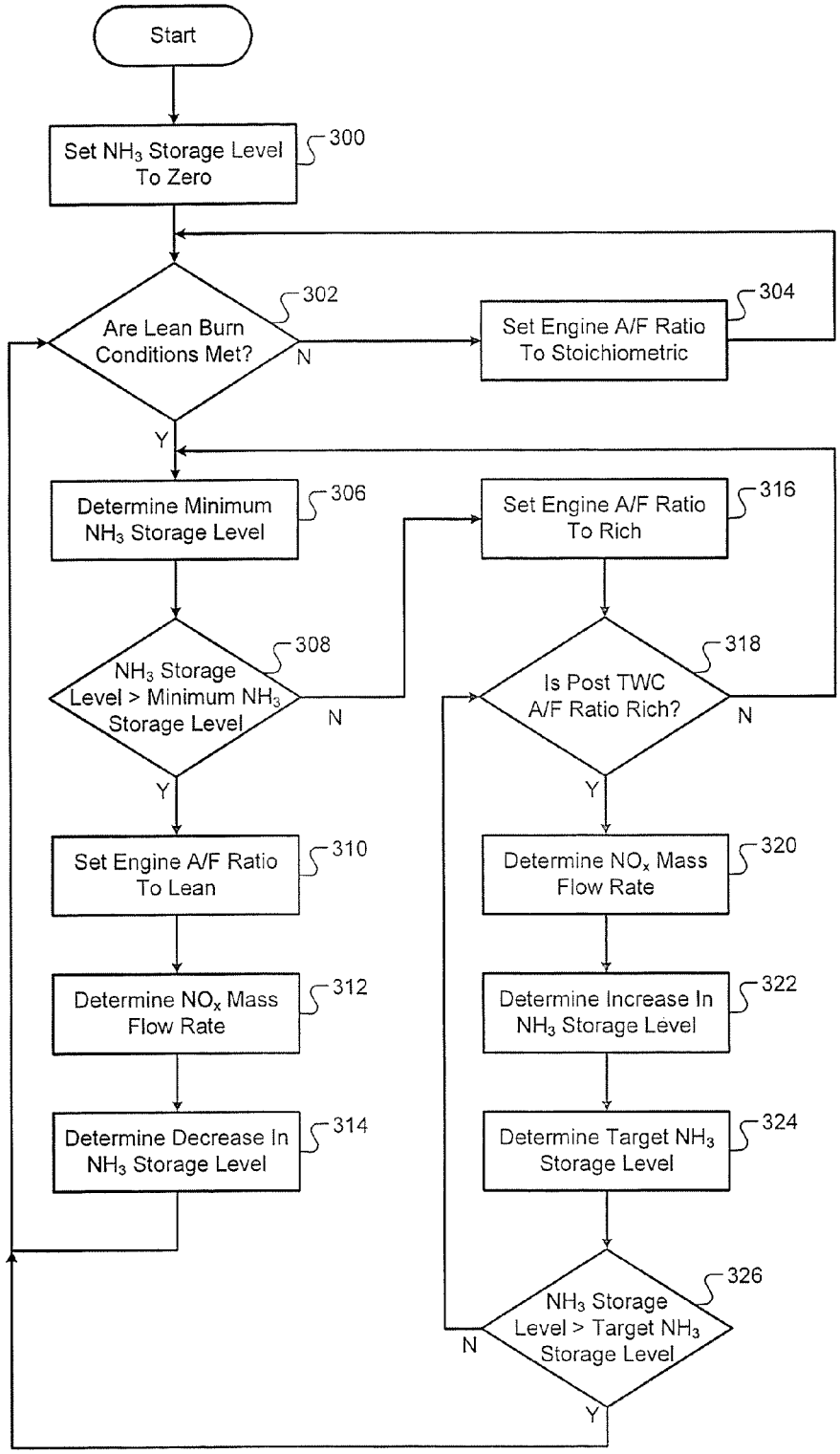
FIG. 3 is a flowchart illustrating exemplary steps of a lean nitrogen oxide ($NO_x$) emission control method according to the principles of the present disclosure.

Referring now to FIG. 3, a flowchart illustrates exemplary steps of a lean $NO_x$ emission control method according to the principles of the present disclosure. In step 300, control sets the $NH_3$ storage level to zero. In step 302, control determines whether lean burn conditions are met. Lean burn conditions may be met when predetermined service indicators are not set and when coolant temperatures, catalyst temperatures, an engine mode, and an engine run time meet predetermined criteria.

When lean burn conditions are not met, control sets the A/F ratio to stoichiometric and continues to determine whether lean burn conditions are met. When lean burn conditions are met, control determines a minimum $NH_3$ storage level and determines whether the $NH_3$ storage level exceeds the minimum $NH_3$ storage level in steps 306 and 308, respectively. Control may determine the minimum $NH_3$ storage level based on a measured exhaust temperature. Alternatively, control may estimate the exhaust temperature based on the engine operating conditions and determine the minimum $NH_3$ storage level based on the estimated exhaust temperature.

When the $NH_3$ storage level exceeds the minimum $NH_3$ storage level, control sets the A/F ratio to lean in step 310, determines a $NO_x$ mass flow rate in step 312, and determines a decrease in the $NH_3$ storage level in step 314. Control determines the $NO_x$ mass flow rate based on an air mass flow rate, a fuel mass flow rate, and a $NO_x$ concentration, which may be measured or estimated. Control may determine the decrease in the $NH_3$ storage level based on the $NO_x$ mass flow rate, the exhaust temperature and a SCR catalyst type. When the decrease in the $NH_3$ storage level is determined, control returns to step 302.

When the $NH_3$ storage level does not exceed the minimum $NH_3$ storage level, control sets the A/F ratio to rich in step 316 and determines whether the post TWC A/F ratio is rich in step 318. When the post TWC A/F ratio is not rich, control returns to step 306. When the post TWC is rich, control determines the $NO_x$ mass flow rate in step 320, determines an increase in the $NH_3$ storage level in step 322, and determines the target $NH_3$ storage level in step 324. Control may determine the increase in the $NH_3$ storage level based on the $NO_x$ mass flow rate, the A/F ratio, and the exhaust temperature. Alternatively, control may determine the increase in the $NH_3$ storage level based on the $NH_3$ concentration, the air mass flow rate, and the fuel mass flow rate. Control may calculate the target $NH_3$ storage level such that its magnitude is above the minimum $NH_3$ storage level and below the $NH_3$ saturation point of the SCR unit 32. For example only, control may set the target $NH_3$ storage level within a range from 20% to 30% below the $NH_3$ saturation point of the SCR unit 32.

In step 326, control determines whether the $NH_3$ storage level exceeds the target $NH_3$ storage level. When the $NH_3$ storage level does not exceed the target $NH_3$ storage level, control returns to step 318 and continues to monitor the $NH_3$ storage level. When the $NH_3$ storage level exceeds the target $NH_3$ storage level, control returns to step 302.

Figure 4:
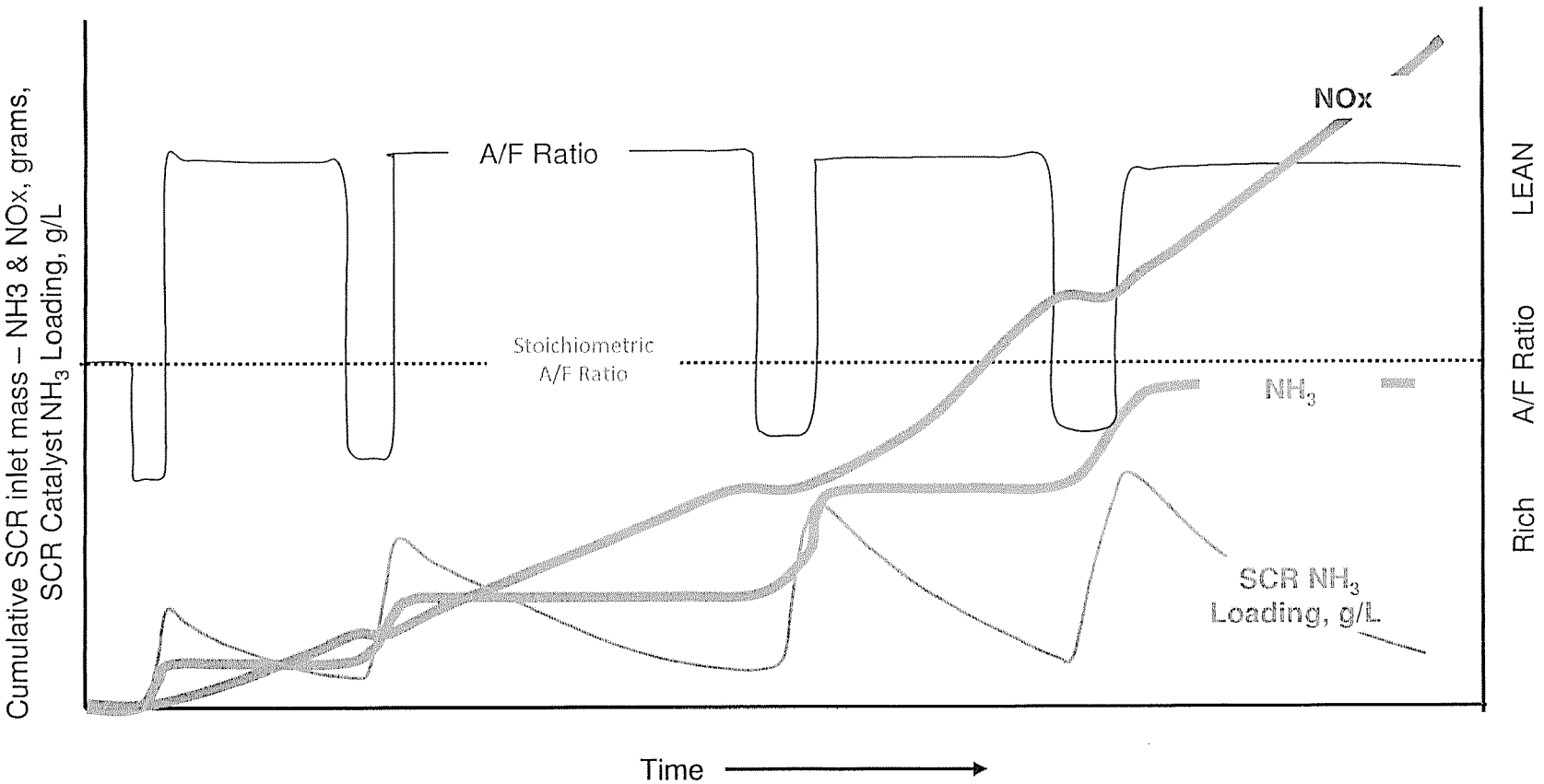
FIG. 4 is a graph illustrating an air-to-fuel (A/F) ratio control signal, resulting cumulative inlet masses of $NH_3$ and $NO_x$ at a selective catalyst reduction (SCR) unit, and resulting $NH_3$ levels in the SCR unit.

Referring now to FIG. 4, a graph illustrates an A/F ratio control signal, resulting cumulative inlet masses of $NH_3$ and $NO_x$ at the SCR unit, and resulting $NH_3$ levels in the SCR unit. The A/F ratio control signal modulates between lean and rich operation. However, the A/F ratio control signal is normally modulated to lean operation to improve fuel economy.

As discussed above, the TWC catalyst reacts with $NO_x$ and other exhaust emissions during rich operation to yield $NH_3$ that is stored in the SCR unit, and the stored $NH_3$ subsequently reacts with $NO_x$ in the exhaust to yield $N_2$ and $H_2O$ during lean operation. Thus, the cumulative inlet mass of $NH_3$ at the SCR unit increases during rich operation and the cumulative inlet mass of $NO_x$ at the SCR unit increases during lean operation. In addition, the $NH_3$ levels in the SCR unit increase during rich operation and decrease during lean operation.

The A/F ratio may be modulated between lean and rich such that the lean $NO_x$ (i.e., $NO_x$ produced during lean operation) is balanced with the rich $NO_x$ (i.e., $NO_x$ produced during rich operation) and the mass of $NH_3$ consumed during lean operation is balanced with the mass of $NH_3$ produced during rich operation. The A/F ratio control signal depicted is biased to result in a slight excess of $NH_3$ emissions and ensure robust $NO_x$ reduction. Modulating the A/F ratio to balance the NOx and $NH_3$ results in effective NOx reduction without excess emissions or fuel consumption. In addition, balancing the $NO_x$ and $NH_3$ may enable the elimination of a LNT and a dosing system, or reduce the amount of dosing agent that must be injected for adequate $NO_x$ reduction. Modulating the A/F ratio to rich for extended durations may worsen fuel economy and increase the $NH_3$ levels above the $NH_3$ storage capacity of the SCR unit, resulting in excess HC and CO emissions. Modulating the A/F ratio to lean for extended durations may deplete the $NH_3$ storage level, resulting in excess $NO_x$ emissions.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system, comprising:

an $NH_3$ storage level determination module that determines an $NH_3$ storage level corresponding to a level of ammonia absorbed in a selective catalytic reduction unit of an exhaust system; and a fuel control module that controls an air-to-fuel (A/F) ratio of an engine based on said $NH_3$ storage level.

2. The control system of claim 1 further comprising a minimum $NH_3$ storage level determination module that determines a minimum $NH_3$ storage level based on an exhaust temperature.

3. The control system of claim 2 wherein said fuel control module sets said A/F ratio to lean when said $NH_3$ storage level exceeds said minimum $NH_3$ storage level.

4. The control system of claim 2 wherein said fuel control module sets said A/F ratio to rich when said $NH_3$ storage level does not exceed said minimum $NH_3$ storage level.

5. The control system of claim 1 further comprising a target $NH_3$ storage level determination module that determines a target $NH_3$ storage level based on an exhaust temperature.

6. The control system of claim 5 wherein said fuel control module sets said A/F ratio to lean when said $NH_3$ storage level exceeds said target $NH_3$ storage level.

7. The control system of claim 1 further comprising a $NO_x$ mass flow rate determination module that determines a $NO_x$ mass flow rate based on a $NO_x$ concentration.

8. The control system of claim 7 wherein said $NH_3$ storage level determination module determines a change in said $NH_3$ storage level based on said $NO_x$ mass flow rate.

9. The control system of claim 8 wherein said $NH_3$ storage level determination module determines said change in said $NH_3$ storage level further based on at least one of an exhaust temperature, a catalyst type, and said A/F ratio.

10. The control system of claim 8 wherein said $NH_3$ storage level determination module determines said $NH_3$ storage level based on a previous $NH_3$ storage level and said change in said $NH_3$ storage level.

11. A method, comprising:

determining an $NH_3$ storage level corresponding to a level of ammonia absorbed in a selective catalytic reduction unit of an exhaust system; and controlling an air-to-fuel (A/F) ratio of an engine based on said $NH_3$ storage level.

12. The method of claim 11 further comprising determining a minimum $NH_3$ storage level based on an exhaust temperature.

13. The method of claim 12 further comprising setting said A/F ratio to lean when said $NH_3$ storage level exceeds said minimum $NH_3$ storage level.

14. The method of claim 12 further comprising setting said A/F ratio to rich when said $NH_3$ storage level does not exceed said minimum $NH_3$ storage level.

15. The method of claim 11 further comprising determining a target $NH_3$ storage level based on an exhaust temperature.

16. The method of claim 15 further comprising setting said A/F ratio to lean when said $NH_3$ storage level exceeds said target $NH_3$ storage level.

17. The method of claim 11 further comprising determining a $NO_x$ mass flow rate based on a $NO_x$ concentration.

18. The method of claim 17 further comprising determining a change in said $NH_3$ storage level based on said $NO_x$ mass flow rate.

19. The method of claim 18 further comprising determining said change in said $NH_3$ storage level further based on at least one of an exhaust temperature, a catalyst type, and said A/F ratio.

20. The method of claim 18 further comprising determining said $NH_3$ storage level based on a previous $NH_3$ storage level and said change in said $NH_3$ storage level.

* * * * *